US010487626B2

(12) United States Patent
Getzlaf et al.

(10) Patent No.: US 10,487,626 B2
(45) **Date of Patent: *Nov. 26, 2019**

(54) FRACTURING VALVE AND FRACTURING TOOL STRING

(71) Applicant: NCS Multistage, Inc., Calgary, Alberta (CA)

(72) Inventors: Donald Getzlaf, Calgary (CA); John Ravensbergen, Calgary (CA); Douglas James Brunskill, Calgary (CA); Shawn Leggett, Okotoks (CA)

(73) Assignee: NCS Multistage, Inc., Calgary (CA)

( * ) Notice: Subject to any disclaimer, the term of this patent is extended or adjusted under 35 U.S.C. 154(b) by 35 days.

This patent is subject to a terminal disclaimer.

(21) Appl. No.: 15/887,264

(22) Filed: Feb. 2, 2018

(65) Prior Publication Data

US 2018/0230776 A1 Aug. 16, 2018

Related U.S. Application Data

(63) Continuation of application No. 14/560,891, filed on Dec. 4, 2014, now Pat. No. 9,903,182, which is a (Continued)

(51) Int. Cl.
*E21B 34/14* (2006.01)
*E21B 34/12* (2006.01)
(Continued)

(52) U.S. Cl.
CPC ..... *E21B 34/14* (2013.01); *E21B 34/12* (2013.01); *E21B 43/26* (2013.01); *E21B 2034/007* (2013.01)

(58) Field of Classification Search
CPC ..... E21B 34/14; E21B 34/12; E21B 34/16; E21B 43/26; E21B 2034/007; F16K 3/12; F16K 3/186
See application file for complete search history.

(56) References Cited

U.S. PATENT DOCUMENTS 5,479,989 A * 1/1996 Shy ..... E21B 34/06 166/332.4
2004/0084187 A1* 5/2004 Costley ..... E21B 37/08 166/312
(Continued)

*Primary Examiner* — David Carroll
(74) *Attorney, Agent, or Firm* — Blank Rome, LLP

(57) ABSTRACT

A fracturing valve comprising a tubular mandrel having a through bore continuous with a tubing string, and a frac window through the side of the tubular mandrel. An outer sleeve is radially disposed around the tubular mandrel. The outer sleeve includes a sleeve port in a sidewall. The tubular mandrel slides relative to the sleeve by application and release of set down weight on a coiled tubing string. When the valve is closed, there is no fluid communication from the tubing string out of the frac window. When the valve is open, fluid communication from the tubing string is enabled. The valve may be installed in a downhole tool having a perforation device. The tool string can be used with one sealing element as the tool is pulled up the hole isolating lower perforations, or with two sealing elements to allow pin-point treatments isolating perforations both up and downhole.

31 Claims, 11 Drawing Sheets

Related U.S. Application Data continuation-in-part of application No. 14/321,558, filed on Jul. 1, 2014, now abandoned.

(60) Provisional application No. 61/911,841, filed on Dec. 4, 2013.

(51) Int. Cl.
*E21B 43/26* (2006.01)
*E21B 34/00* (2006.01)

(56) References Cited

U.S. PATENT DOCUMENTS

| | | | | |
|---|---|---|---|---|
| 2009/0159299 | A1* | 6/2009 | Kratochvil | E21B 33/124 166/387 |
| 2010/0243254 | A1* | 9/2010 | Murphy | E21B 23/01 166/305.1 |
| 2012/0090847 | A1* | 4/2012 | Getzlaf | E21B 23/02 166/305.1 |
| 2013/0299200 | A1* | 11/2013 | Hughes | E21B 33/12 166/387 |
| 2015/0376979 | A1* | 12/2015 | Mitchell | E21B 33/124 166/373 |

* cited by examiner 6
116
5B
5B
20
15

60

70
15

70
5A
5A
15
118
112
6
15
20

60
75
70
80
118
112

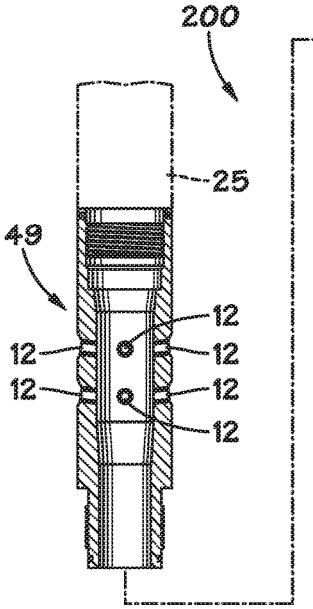
FIG. 7A
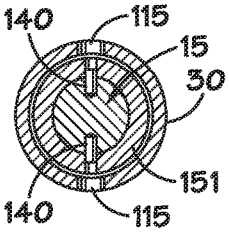
FIG. 7B
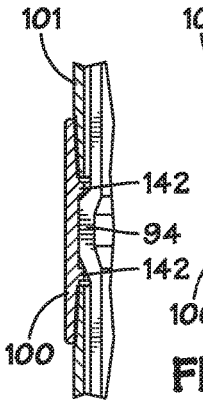
FIG. 7C
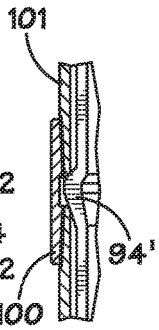
FIG. 7D
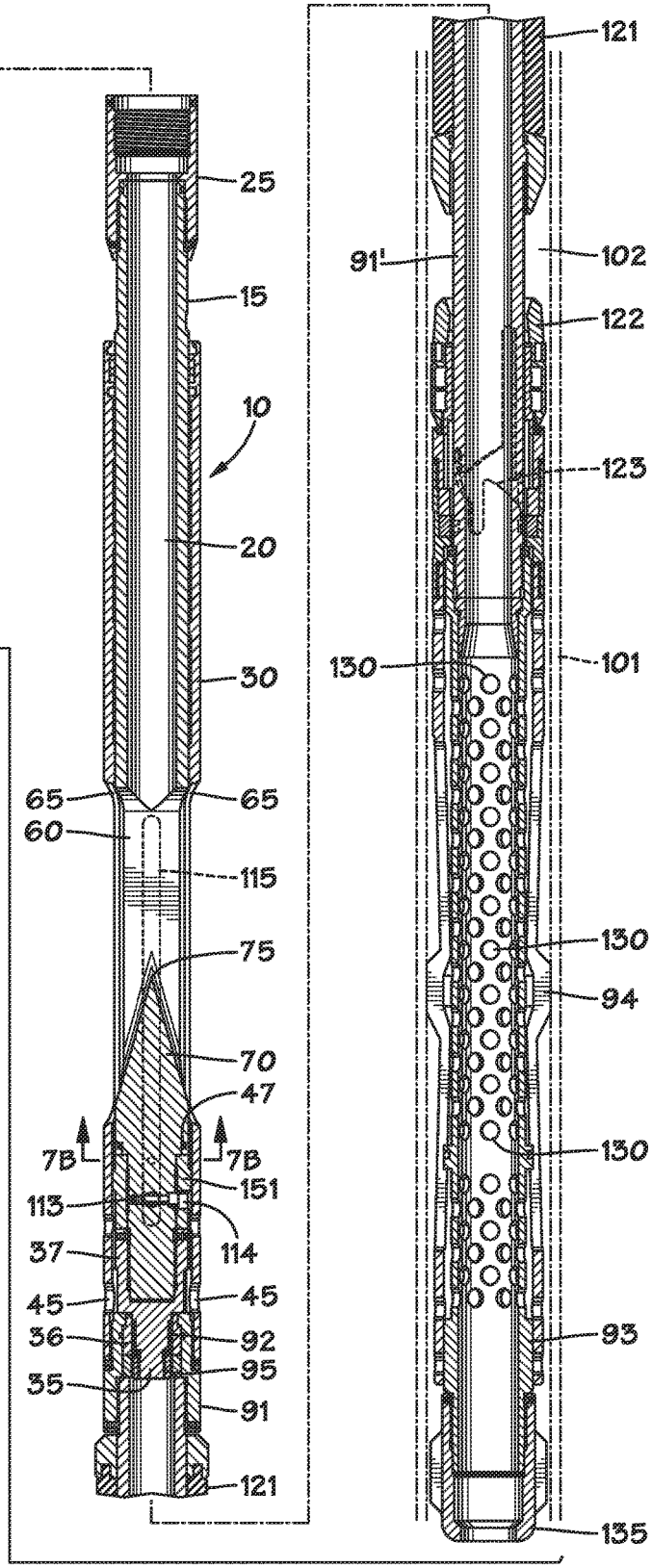

FRACTURING VALVE AND FRACTURING TOOL STRING

CROSS-REFERENCE TO RELATED APPLICATIONS

This application is a continuation of U.S. patent application Ser. No. 14/560,891 filed Dec. 4, 2014, which is a continuation-in-part of U.S. patent application Ser. No. 14/321,558 filed Jul. 1, 2014, which claims priority to U.S. Provisional Application No. 61/911,841 filed Dec. 4, 2013, the contents of all of which are hereby incorporated by reference in their entirety.

STATEMENT REGARDING FEDERALLY SPONSORED RESEARCH OR DEVELOPMENT

Not Applicable.

BACKGROUND OF THE INVENTION

1. Field of the Invention

The present invention generally relates to hydraulic fracturing. More particularly, it relates to a downhole tool having a valve for controlling the flow of fracturing fluids.

2. Description of the Related Art Including Information Disclosed Under 37 CFR 1.97 and 1.98

Well completion operations are commonly performed after drilling hydrocarbon-producing wellbores. Part of the completion operation typically involves running a casing assembly into the well. The casing assembly may include multiple joints of casing connected by collars. After the casing is set, perforating and fracturing operations may be performed.

Perforating involves forming openings through the well casing and into the adjacent formation. A sand jet perforator may be used for this purpose. Following perforation, the perforated zone may be hydraulically isolated. Fracturing operations may be performed to increase the size of the initially formed openings in the formation. During fracturing, proppant materials are introduced into enlarged openings in an effort to prevent the openings from closing.

In downhole completion and servicing operations, it may be useful to selectively enable fluid communication between the tubing string and the well bore surrounding the tubing string (i.e., the annulus). It may also be useful for operations such as perforating and fracturing to be performed using a single downhole tool having both capabilities. This avoids the need for multiple trips downhole and uphole, which in turn allows for fluid conservation and time-savings. It may also be useful to carry out operations such as fracturing by pumping treatment fluid down a coiled tubing string. One reason for this is that the coiled tubing string has a smaller cross-sectional area than the wellbore annulus (the annulus being defined as the region between the coiled tubing and the wellbore or, for cased wellbores, the annulus is defined as the annular space between the casing and the coiled tubing). Because of the smaller cross-sectional area of coiled tubing, smaller volumes of fluids (displacement and treatment fluids, for example) may be used.

There exist various circulation valves that allow for fluid to be circulated between different functional components within a single downhole tool. However, many of these valves employ ball-seat arrangements. In ball-seat valves, the ball must be reverse-circulated to the surface after one operation is completed, resulting in a corresponding increase in fluid use and time. Because downhole treatment operations utilize large quantities of fluids, methods or tools that result in fluid savings are desirable.

Various techniques for fracturing that do not require removal of the downhole tool following perforation have been developed. For example, in the SurgiFrac® multistage fracturing technique (Halliburton Company, 10200 Bellaire Blvd., Houston, Tex. 77072), perforating may be carried out by means of a downhole tool having a jet perforation device with nozzles. Perforation may then be followed by pumping a fracturing treatment down the coiled tubing, out of the jet perforation nozzles and into the formation, without the need to remove the downhole tool from the wellbore between perforation and fracturing. Because the diameter of the jet perforation nozzles may be small, a large pressure differential may exist between the interior of the tubing string and the formation, making it challenging to pump treatment fluid at sufficiently high pressure to overcome the pressure differential. Furthermore, proppant is typically used in fracturing. There are often issues associated with moving proppant-laden treatment from the inside of the coiled tubing to the formation. The proppant may become wedged inside the nozzles, preventing its exit into the formation.

Fracturing techniques that rely on the use of fracture valves or fracture sleeves have also been developed. For example, in multi-zone wells, multiple ported collars in combination with sliding sleeve assemblies have been used. The sliding sleeves or valves are installed on the inner diameter of the casing, sometimes being held in place by shear pins. Often the bottom-most sleeve is capable of being opened hydraulically by applying a pressure differential to the sleeve assembly. Fracturing fluid may be pumped into the formation through the open ports in the first zone. A ball may then be dropped. The ball hits the next sleeve up, thereby opening ports for fracturing the second zone.

Other techniques and tools do not require the ball-drop technique. For example, some techniques involve deploying a bottom hole assembly (BHA) with perforating ability and sealing ability. For example, it may be possible to perforate a wellbore using a sand jet perforator, or other perforation device. Following perforation, the wellbore annulus may be sealed using a packer or other sealing means. When fluid is pumped down the coiled tubing, a pressure differential may be created across the sealing means, thereby enabling the fracture valve or sleeve to open, exposing a fracture port. Treatment fluid may then be delivered through the fracture port into the formation. The use of sliding sleeves adds costs to the fracturing operation. Sliding sleeves may reduce the inner diameter of the casing. Also, there may be circumstances where the sleeves do not reliably open, for example, once the environment surrounding the sleeve becomes laden with proppant and other debris.

Therefore, it would be desirable to employ a downhole tool that has both fracturing and perforating capabilities and which allows for fluid savings, time-savings, reproducibility and low-cost manufacture.

BRIEF SUMMARY OF THE INVENTION

The present invention concerns a valve and method for fracturing, and a tool for carrying out perforating and fracturing. The valve may be manipulated by mechanical action (e.g. pushing and pulling on the tubing string in which the valve is installed). This mechanical manipulation results in the opening and closing of the valve. More particularly, the valve may be moved from an open position wherein fracturing fluid pumped from the surface through the tubing string may exit the tool through a passageway formed in the tool to a closed position where fracturing fluid pumped down the tubing string cannot exit the tool. The valve may be installed in a tool having a perforation device. In such a tool, perforation may be carried out when the valve is closed. The valve may be opened by manipulation of the tubing string, allowing fluid flow through a passageway in the tool to the exterior of the tool. Fracturing fluid may be pumped through this passageway.

The valve allows for fracturing to be performed by pumping fracturing fluid (e.g., proppant-containing treatment fluid) and optionally various other fluids down the coiled tubing string without the need for sliding sleeves to open a frac port, and without the need to pump the treatment fluid through perforation nozzles. Since the volume of some coiled tubing strings may be three times less than the volume of the annulus of a typical wellbore, less fluid may be required when pumping treatment fluid(s) down a coiled tubing string. Moreover, because of the smaller volume of the coiled tubing string versus the annulus, less time may be required to perform the fracturing treatment. The valve may be actuated from an open position to a closed position by pulling up on the coiled tubing string and from a closed position to an open position by pushing down on the coiled tubing string to which the valve is attached. The valve has features that allow for effective delivery of proppant pumped down the coiled tubing string to the formation. In a tool that includes a perforation device, perforation may be performed when the valve is closed. The valve may be opened by pushing down on the coiled tubing string, and fracturing may occur (following displacement of any perforation fluid) without tripping uphole between perforating and fracturing operations. The method of perforating and fracturing may involve sequentially perforating and then fracturing individual zones of the formation from the bottom to the top of the completion interval.

According to one aspect, the invention comprises a method of perforating and fracturing a formation intersected by a wellbore, the method including the steps of: (a) deploying a tool on a tubing string into the wellbore, the tool having a perforation device and having the capability of carrying out fracturing following perforation by pushing down on the tubing string to open a fluid passageway in the tool in fluid communication with the tubing string and with the exterior of the tool when the coiled tubing is pushed down, such that fracturing fluid may exit the tubing string through the fluid passageway to the formation; (b) perforating an interval of the formation; (c) pushing down on the tubing string to open the fluid passageway in the tool; and (d) pumping fracturing treatment fluid through the coiled tubing string into the perforations created by the perforation device without removing the tool from the formation between perforation and fracturing.

According to one embodiment, the method further comprises repeating steps (b), (c) and (d), above for at least one additional interval of the formation.

In another embodiment, the fluid passageway may be formed between a fracturing window in the sidewall of a tubular mandrel in the tool and a port formed in a sidewall of a sleeve, the sleeve being radially disposed around the tubular mandrel. The tubular mandrel may be slidable relative to the sleeve by manipulation of the coiled tubing string, and this sliding movement effects opening and closing of the valve. Pushing down on the coiled tubing string seals a passageway in the tubing string below the fracturing window and allows fracturing treatment to exit the coiled tubing string to the formation through the fracturing window and sleeve port. Pulling up on the tubing string unseals a passage to the tubing string and closes the fracturing valve.

According to another embodiment, the method further comprises pumping fracturing treatment fluid onto a sloped surface within the tubular mandrel downhole of the window when the valve is in the open position. The sloped surface or wedge diverts proppant to the formation.

According to another embodiment, the method further comprises sealing the wellbore annulus defined between the tubing string and the casing lining the wellbore before pumping fracturing treatment down the coiled tubing string.

According to another aspect, there is provided a fracturing valve for a downhole tool. The valve includes a tubular adapted to be connected in a tubing string. The tubular has a throughbore and a window through the tubular. An outer sleeve is disposed around the tubular. The outer sleeve has a port formed in a sidewall of the sleeve. The valve may be arranged such that the tubular and the sleeve are axially moveable relative to one another from a first position in which fluid may exit the valve and a second position in which fluid cannot exit the valve and the valve being further arranged such that movement from the first position to the second position may be effectuated by applying a mechanical force to the tubular.

In the second or closed position, a seal disposed between the tubular and the sleeve prevents fluid flow down the tubing string to the window. In a first or open position, the tubing string below the window may be blocked (e.g., by a slidable plug) to ensure fluid is delivered out the fracturing window.

According to another embodiment, the fracturing valve of the present invention may be used in a pin point treatment design where in addition to the hydraulic seal below the valve and perforation device, there is another sealing element above this devices, creating a treatment zone. In this embodiment a hydraulic hold down with hydraulically actuated hydraulic hold down buttons is preferably used above the upper seal mechanism to prevent the pressure under the upper seal mechanism from attempting to push up on the tool string and closing the fracturing valve.

BRIEF DESCRIPTION OF THE SEVERAL VIEWS OF THE DRAWINGS

FIG. 7A is a longitudinal, cross-sectional view of a downhole tool comprising a fracturing valve and equalization valve according to one embodiment of the invention, an annular packer with J-slot actuator, a bottom sub with a casing collar locator, and a bullnose centralizer. The fracturing valve is shown in the open position; the equalization valve is shown in the closed position; and, the packer is shown in the unset condition.

FIG. 7B is a transverse, cross-sectional view taken along line 7B-7B in FIG. 7A.

FIG. 7C is a longitudinal, cross-sectional view of one side of a casing collar of a first type and a corresponding casing collar locator.

FIG. 7D is a longitudinal, cross-sectional view of one side of a casing collar of a second type and a corresponding casing collar locator.

DETAILED DESCRIPTION OF THE INVENTION

Figures 1A, 1B:
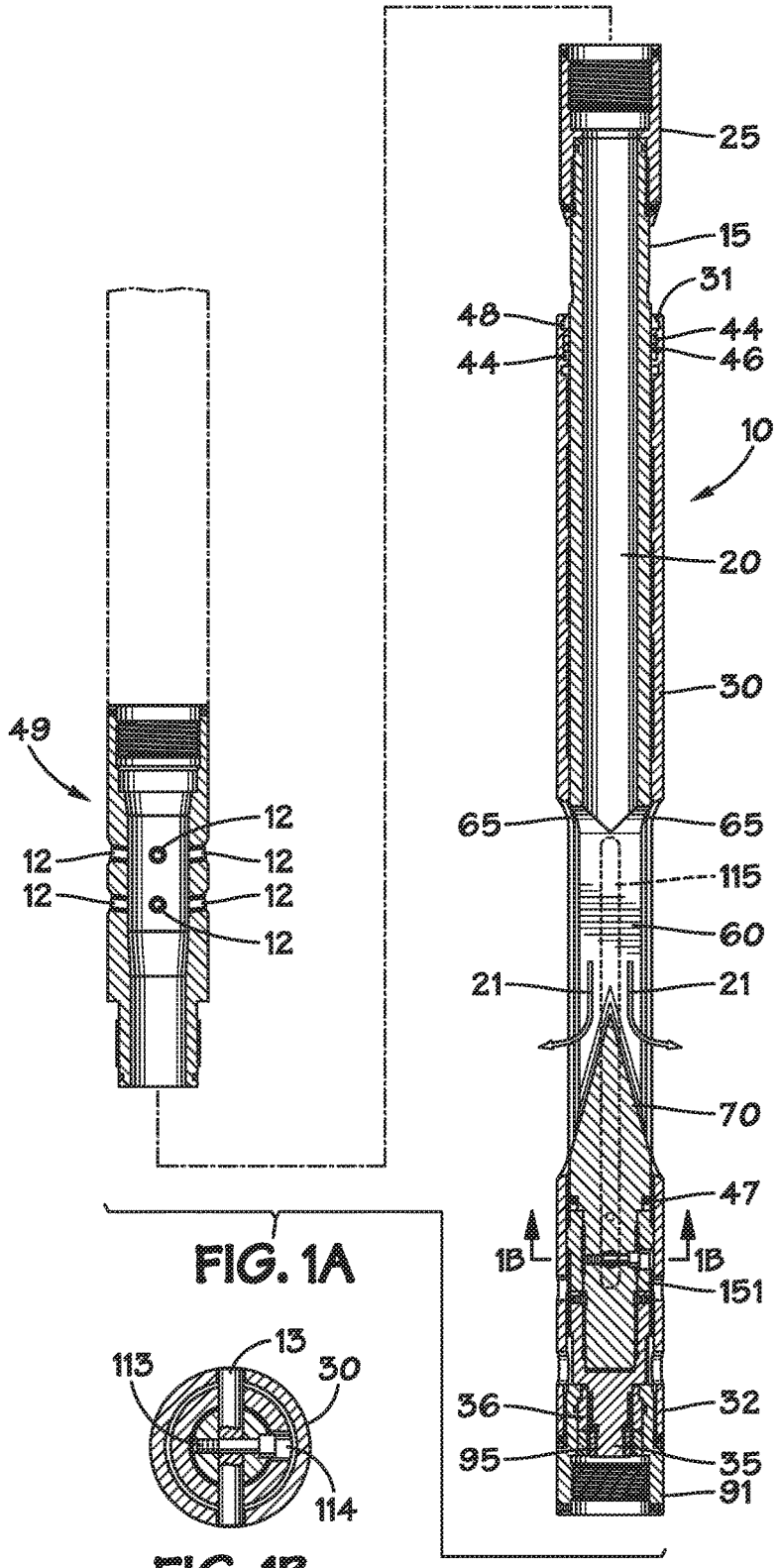
FIG. 1A is a longitudinal, cross-sectional view of a jet perforation device and fracturing valve according to one embodiment, the fracturing valve being shown in the open position.
FIG. 1B is transverse cross-sectional view taken along line 1B-1B in FIG. 1A.

The invention may best be understood by reference to the exemplary embodiment(s) illustrated in the drawing figures wherein the following reference numbers are used:

fracturing valve 10
nozzles 12
alignment pin 13
tubular mandrel 15
throughbore 20
flow path 21
tubing string 25
outer sleeve 30
upper end 31 of outer sleeve 30
lower end 32 of outer sleeve 30
equalization plug 35
back-up ring 44
circulation ports 45
O-ring 46
O-ring 47
wiper 48
perforation device 49
frac window 60
sleeve port 65 (in sidewall of sleeve 30)
wedge member 70
apex 75
base 80
equalization housing 91
lower mandrel 91'
sealing surfaces 92
bottom sub 93
mechanical collar locator 94
cap 95 (connected to lower mandrel 91)
perforations 99
casing collar 100
casing 101
annulus 102
formation 103
threaded bore 112 (for lock screw 113)
lock screw 113
radial opening 114
slot 115 (in sleeve 30)
tool engagement grooves 116
shoulder 117
cross bore 118 (for alignment pin 13)
sealing element (annular packer) 121
anchor 122
J-slot 123 (grooved into lower mandrel 91)
ports 130 (in bottom sub 93 in the region of collar locator 94)
bullnose centralizer 135
pins 140
lands 142
seal retainer (housing) 151
downhole tool 200
Hydraulic Hold Down 172
Hydraulic Buttons 170

A detailed description of one or more embodiments of the valve and methods for it use are presented herein by way of example and not limitation with reference to the drawing figures.

As used herein, the terms "above," "up," "uphole," "upward," "upper" or "upstream" mean away from the bottom of the wellbore along the longitudinal axis of the workstring. The terms "below," "down," "downhole," "downward," "lower" or "downstream" mean toward the bottom of the wellbore along the longitudinal axis of the workstring. The terms "workstring" or "tubing string" refer to any tubular arrangement for conveying fluids and/or tools from the surface into a wellbore.

As will be detailed in the following disclosure, a downhole tool 200 comprising a frac valve 10 according to the invention may comprise four distinct active elements actuated by applying weight or tension to a coiled tubing string to which downhole tool 200 is connected. Those active elements are:

a fracturing valve;
an equalization valve;
a mechanical anchoring mechanism (slips); and,
an annular packer.

Referring first to FIG. 1A, a frac valve 10 according to the invention is shown together with a jet perforating sub 49 equipped with a plurality of jet perforating nozzles 12 for creating openings in a surrounding well casing or liner and into cement filling the annulus between the casing or liner and the wellbore and even into the formation itself. Such openings may be created by pumping an abrasive-laden fluid at relatively high velocity down the tubing string and out the nozzles. As indicated in FIG. 1A, jet perforating sub 49 may be coupled to the upper end of frac valve 10 to form tubing string 25. Thus, in order to preferentially direct fluid out of nozzles 12, frac valve 10 would ordinarily be placed in the closed position during a perforating operation.

Frac valve 10 comprises tubular mandrel 15 which is configured to slide axially relative to outer sleeve 30 in response to weight or tension applied to tubing string 25 (which may be connected to a pipe string, coiled tubing, or other conduits known in the art). Mandrel 15 has central axial bore 20 for the passage of fluids conveyed by the tubing string. Outer sleeve 30 has one or more ports (or "windows") 65 in its side wall. Mandrel 15 has corresponding openings 60 (see FIG. 5). When ports 65 and openings 60 are aligned (as illustrated in FIG. 1A), frac valve 10 is in the "open" condition and fluid pumped down bore 20 may exit the device in a radial direction after impinging on wedge 70 as indicated by flow arrows 21.

Figures 5, 5A, 5B, 6:
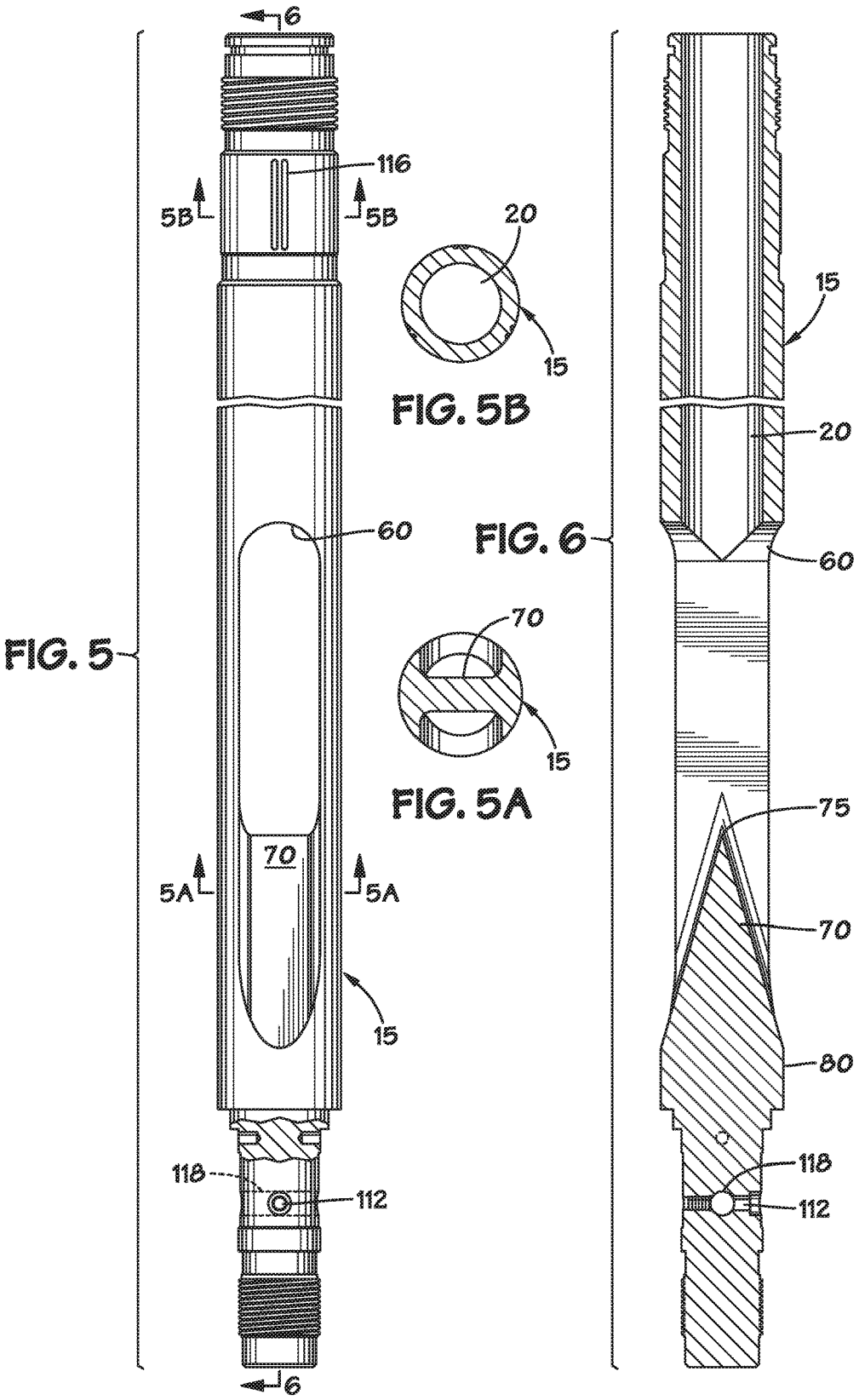
FIG. 5 is a side view, partially in cross section, of a tubular mandrel which forms a portion of the fracturing valve illustrated in FIG. 1A.
FIG. 5A is transverse cross-sectional view taken along line 5A-5A in FIG. 5.
FIG. 5B is transverse cross-sectional view taken along line 5B-5B in FIG. 5.
FIG. 6 is a longitudinal, cross-sectional view taken along line 6-6 in FIG. 5

Angular alignment of ports 65 and openings 60 is maintained by radial pin 13 sliding in axial slots 115 in the wall of outer sleeve 30. Pin 13 may be secured in cross bore 118 in mandrel 15 with screw 113 accessible via opening 114 (when opening 114 is positioned adjacent port 65 by sliding mandrel 15 relative to sleeve 30). As illustrated in FIG. 6, a portion of bore 112 may be internally threaded to engage locking screw 113.

In the illustrated embodiment, the sealing action of frac valve 10 is obtained by lower O-ring 47 and upper O-ring seal 46. Upper O-ring seal 46 may be flanked by backup rings 44. Wiper 48 may be provided near upper end 31 of outer sleeve 30 to protect upper O-ring seal 46 and backup rings 44 from abrasive debris in the wellbore.

Figure 2:
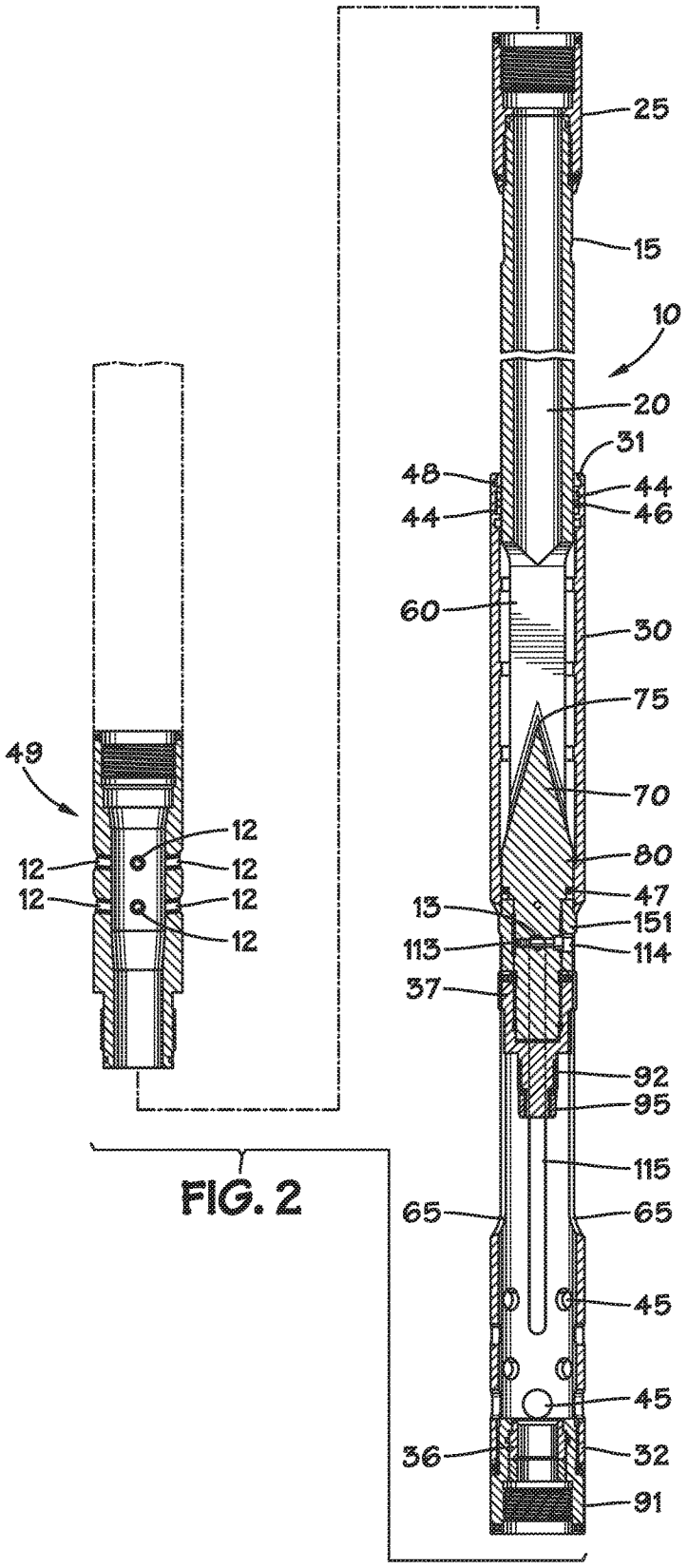
FIG. 2 is a longitudinal, cross-sectional view of the jet perforation device and fracturing valve shown in FIG. 1A with the fracturing valve shown in the closed position.

Also shown in FIG. 1A is an equalization valve proximate lower portion 32 of outer sleeve 30 comprising equalization plug 35 which seats and unseats in equalization housing 91 (which may be provided with cap 95) when mandrel 15 slides axially relative to sleeve 30. It will be appreciated that when frac valve 10 is open (mandrel 15 positioned such that sleeve ports 65 and frac window 60 are aligned), the equalization valve is closed. Conversely, when frac valve 10 is closed (mandrel 15 extended), the equalization valve is open. Frac valve 10 is shown in its closed position in FIG. 2. In this state, O-ring 47 provides a fluid-tight seal between mandrel 15 and the inner wall of sleeve 30 above sleeve ports 65 thereby preventing fluid in bore 20 from exiting the tubing string through any apertures below. Upward travel of mandrel 15 relative to outer sleeve 30 (which may be effected by applying tension to the tubing string) is limited by the shoulder on mandrel 15 contacting an inner shoulder on outer sleeve 30. Downward travel of mandrel 15 relative to outer sleeve 30 (which may be effected by applying weight to the tubing string) is limited by shoulder 117 (FIG. 3) contacting the upper end of equalization housing 91. As shown in FIG. 2, equalization valve plug 35 may be provided with circumferential seals 92 which may sealingly engage the inner bore of sealing ring 36 in equalization housing 91. In certain embodiments, seals 92 may be bonded seals.

It will be appreciated that, when frac valve 10 is in the closed position (mandrel 15 extended), fluid pumped down the tubing string is forced to exit via nozzles 12 in perforation sub 49. Inasmuch as it is generally advantageous to have maximum fluid flow during a jet perforation operation, having equalization plug 35 unseated during such operation is desirable because in effect it provides a larger diameter flow path for fluid movement downhole. A frac valve according to the invention provides this configuration automatically upon closing the frac valve.

When equalization plug 35 is withdrawn from its seat in equalization housing 91, fluids within the tubing string below mandrel 91 may communicate with annulus 102 (FIGS. 7A, 8, 9 and 11) via the central axial bore of equalization housing 91 and circulation ports 45, slot 115 and sleeve ports 65. In this way, pressure equalization in the wellbore may be obtained.

Figure 3:
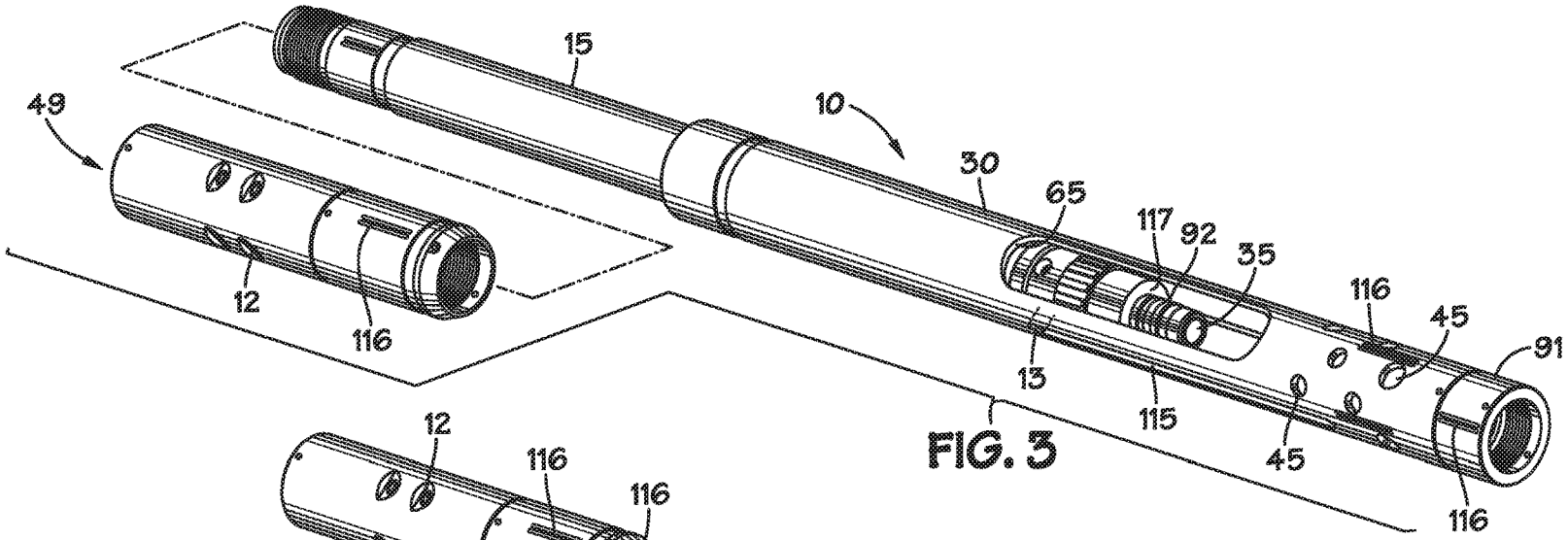
FIG. 3 is a three-dimensional view of the jet perforation device and fracturing valve illustrated in FIG. 1A with the fracturing valve shown in the closed position.
Figure 4:
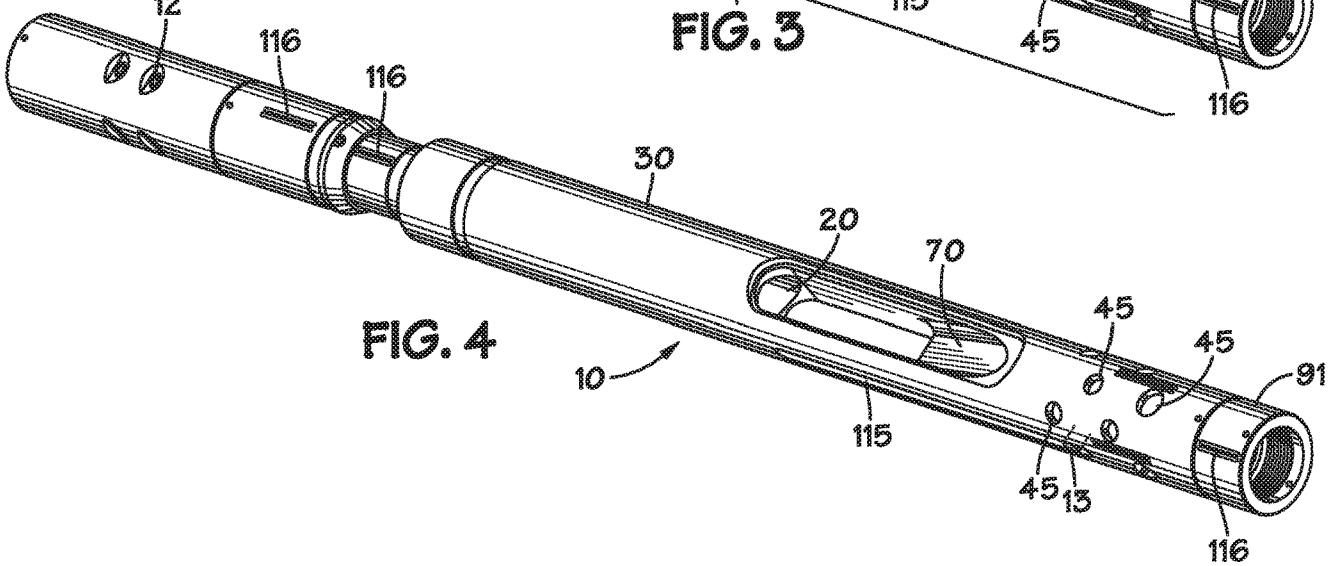
FIG. 4 is a three-dimensional view of the jet perforation device and fracturing valve illustrated in FIG. 1A with the fracturing valve shown in the open position.

As may be seen in FIGS. 3 and 4, equalization housing 91 and jet perforation sub 49 may be connected to frac valve 10 by threaded connectors. To facilitate the assembly and/or disassembly of the device, longitudinal grooves 116 may be provided at selected locations on the outer surfaces of the component pieces for tool engagement.

As illustrated in FIG. 6, fluid impingement wedge 70 comprises an apex 75 at its uphole end and a base section 80 at its downhole end. Opposing sloped surfaces on wedge 70 between apex 75 and base 80 act to deflect fracking fluids pumped down central bore 20 radially out of mandrel 15 via frac windows 60.

Referring now to FIG. 7A, downhole tool 200 comprises jet perforating sub 49, frac valve 10, and an assembly comprising an annular packer 121, an anchor 122 actuated by auto J-slot 123 (grooved into equalization housing 91'), and a mechanical casing collar locator (MCCL) 94 surrounding bottom sub 93. A plurality of circulation ports 130 are provided in bottom sub 93. Bullnose centralizer 135 is connected to the downhole end of bottom sub 93. This assembly is shown in casing 101 with annular packer 121 and anchor 122 unset. Annulus 102 is defined between the outer diameter of tool 200 and the inner diameter of casing 101.

FIG. 7B illustrates one particular preferred means for securing seal 47 on mandrel 15. A section of reduced outside diameter on mandrel 15 creates a shoulder on which O-ring 47 may be seated. Ring-shaped seal retainer 151 is configured to abut this shoulder and may be secured to a lower shank portion of mandrel 15 with pins 140. Pins 140 may be accessible via slots 115.

As illustrated in FIG. 7A, connector portion 37 of the equalization valve may also attach to the lower shank portion of mandrel 15 with set screws or equivalent means. In certain embodiments, these set screws may be accessible via selected circulation ports 45.

FIGS. 7C and 7D illustrate how the profile of MCCL 94 may be selected to match the particular type of casing collar employed in a certain well completion. In FIG. 7C, casing collar 100 is of a type having lands 142 which project in an inward, radial direction and which may contact the ends of casing segments 101 when the joint is fully made up. Mechanical casing collar locator 94 has a profile that is sized and configured to fit between lands 142. Casing collar 100' shown in FIG. 7C is of a type not having projecting lands. MCCL 94' has a profile that is sized and configured to fit in the space between the ends of casing segments 101.

Figure 8:
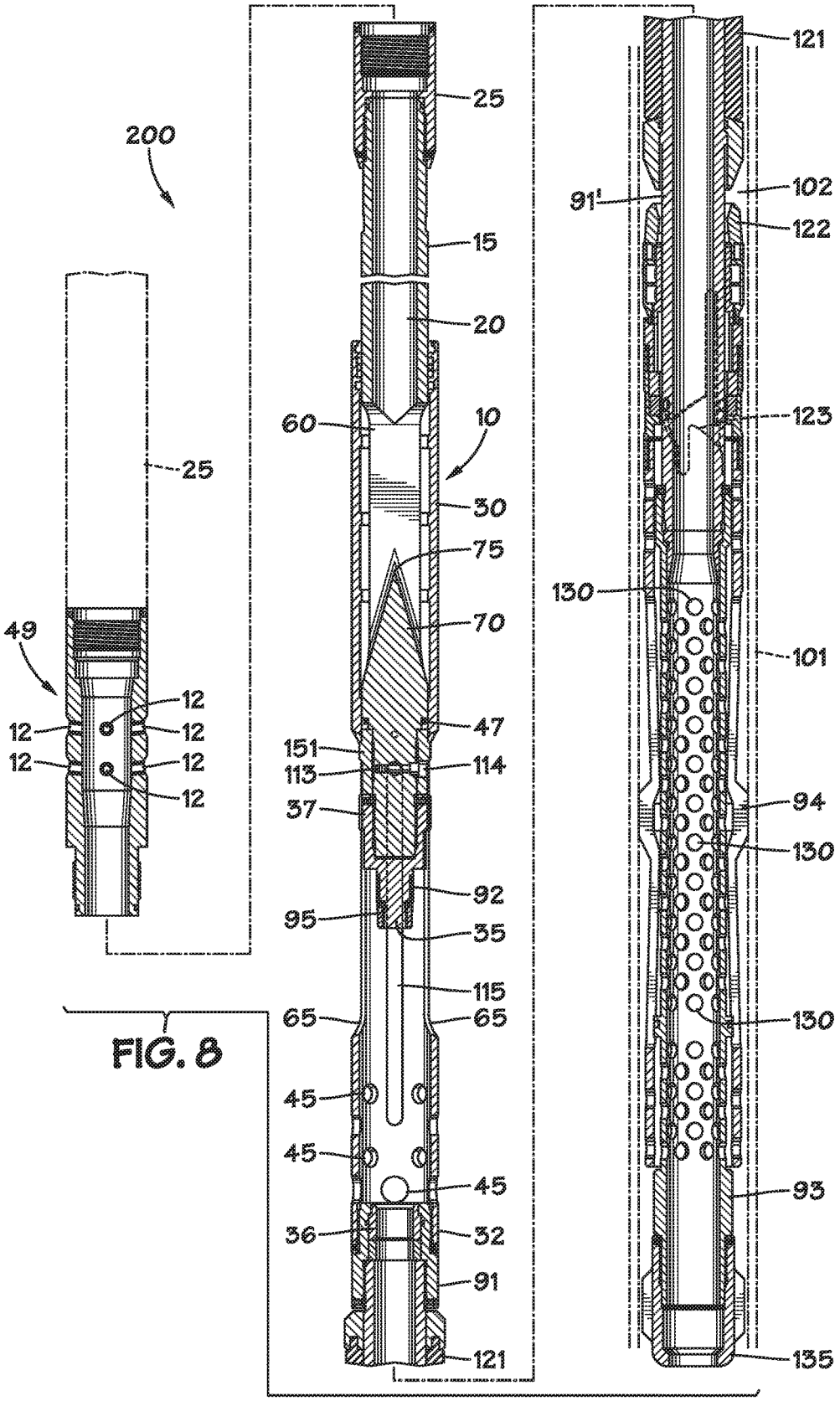
FIG. 8 is a longitudinal cross-sectional view of the downhole tool illustrated in FIG. 7A shown in an extended, tensioned state with the fracturing valve in the closed position and the equalization valve in the open position.
Figure 9:
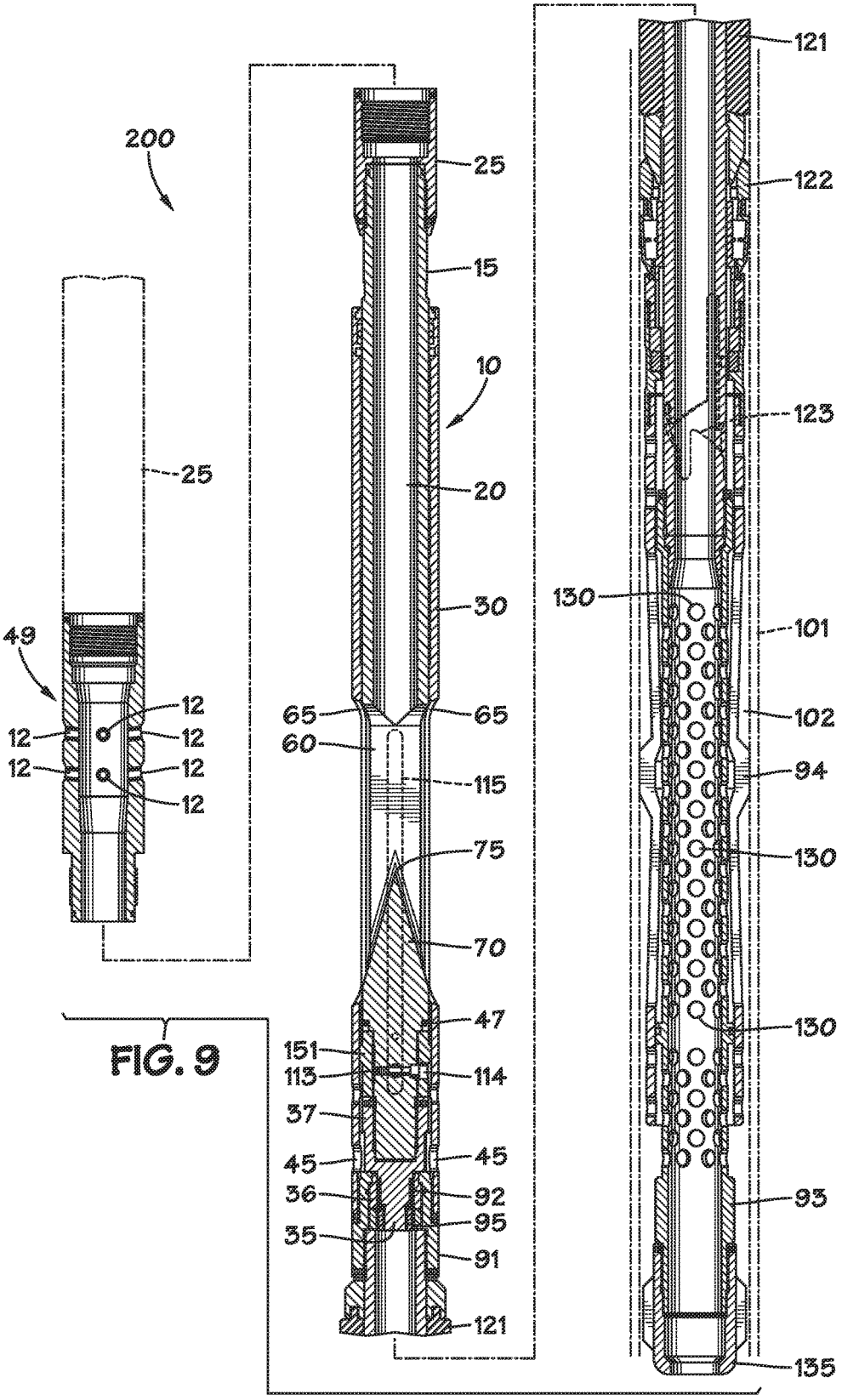
FIG. 9 is a is a longitudinal cross-sectional view of the downhole tool illustrated in FIG. 7A shown in a retracted, compressed state with the fracturing valve in the open position and the equalization valve in the closed position.
Figure 10:
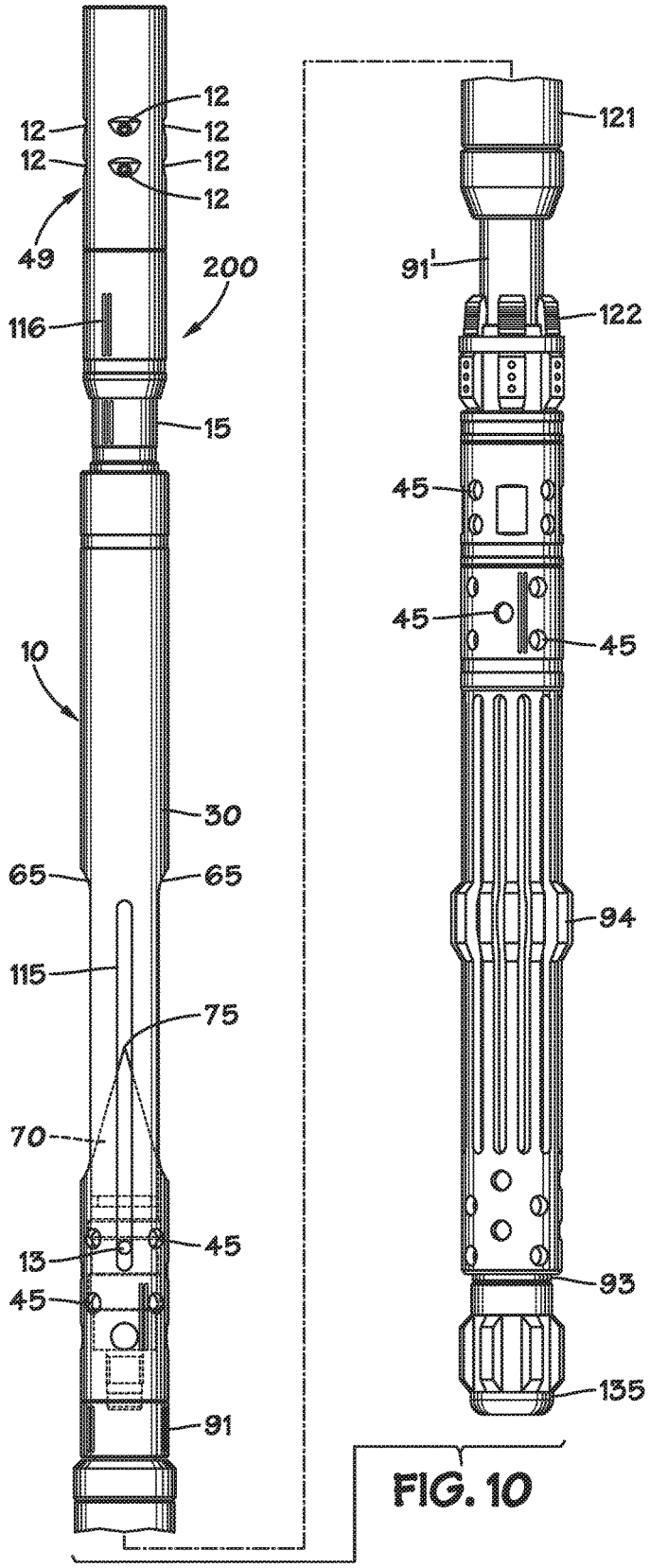
FIG. 10 is a side view of the downhole tool illustrated in FIG. 7A. The tool is illustrated with the fracturing valve in the open position.

FIGS. 7A, 8, and 9 show tool 200 in three, different, operating states. In FIG. 7A, tool 200 is in the run-in state. This state is obtained by applying weight (downhole force) to a tubing string attached to the upper end of the tool. The frac valve is open; the equalization valve is closed; and, the annular packer 121 and anchor 122 are unset.

In FIG. 8, tool 200 is shown in a state suitable for a perforation operation using sand jet perforating sub 49. This state is obtained by applying tension (uphole force) to a tubing string attached to the upper end of the tool sufficient to cause mandrel 15 to extend. An opposing drag force is provided by the contact of MCCL 94 with the inner wall of casing 101. The frac valve is closed; the equalization valve is open; and, the annular packer 121 and anchor 122 are unset. Abrasive-containing fluid pumped down the tubing string is forced to exit via nozzles 12 in jet perforation sub 49. Jet perforation fluids may flow downhole from the wellbore interval occupied by tool 200 via annulus 102 and/or via the central bore of outer sleeve 30 (entering via windows 65, slot 115 and/or circulation ports 45) and out ports 130. Moving to the state shown in FIG. 8 from that shown in FIG. 7A causes auto J-slot 123 to cycle once, moving anchor 122 closer to, but spaced apart from, annular packer 121.

In FIG. 9, tool 200 is shown in a state suitable for a fracking operation. This state is obtained subsequent to that shown in FIG. 8 by again applying weight (downhole force) to a tubing string, or tubing conveyance mechanism (jointed coiled tubing or any other suitable tubular, but preferably coiled tubing) attached to the upper end of the tool sufficient to cause mandrel 15 to telescope into outer sleeve 30. An opposing drag force is provided by the contact of MCCL 94 with the inner wall of casing 101. Moving to the state shown in FIG. 9 from that shown in FIG. 8 causes auto J-slot 123 to cycle again, allowing anchor 122 to engage the inner wall of casing 101 and annular packer 121 to be compressed thereby expanding radially. The frac valve is open; the equalization valve is closed; and, the annular packer 121 and anchor 122 are set. Fracking fluids pumped down the tubing string impinge on wedge 70 and are forced to exit via windows 65. Downhole flow of fracking fluids is prevented by annular packer 121.

Following completion of the fracking operation, the application of tension (uphole force) to a tubing string attached to the upper end of the tool causes the frac valve 10 to close, the equalization valve to open (equalizing the fluid pressure across the interval) and the auto J-slot to cycle once which permits annular packer 121 and anchor 122 to unseat. Tool 200 would then be in the state illustrated in FIG. 8 which is suitable for moving tool 200 uphole to the next interval to be perforated and fracked.

Figure 11A:
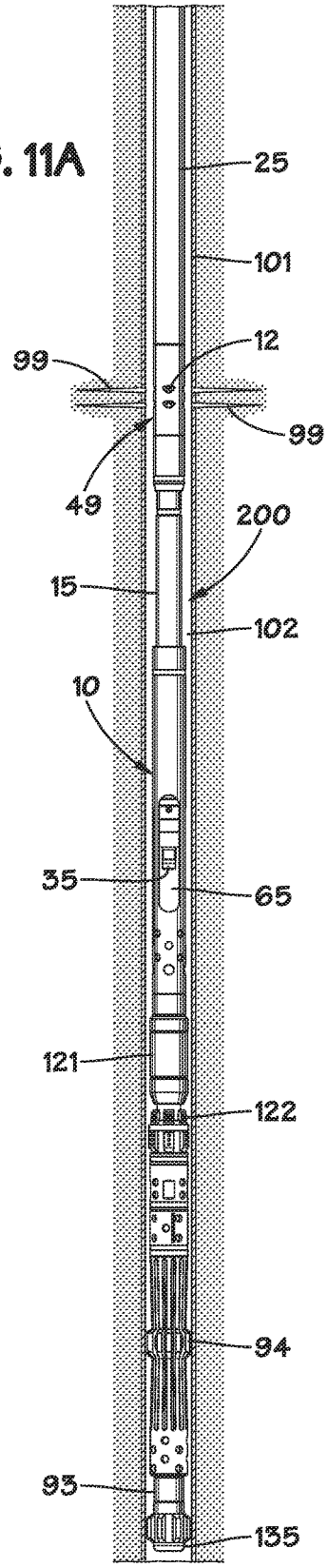
FIG. 11A is a side view, partially in cross section, of the downhole tool shown in FIG. 10 positioned for perforating a cased wellbore. The fracturing valve is shown in the closed position; the equalization valve is shown in the open position; and, the bridge plug is unset.

A perforating operation in a cased wellbore is illustrated in FIG. 11A. The tool is in the state shown in FIG. 8—i.e., the frac valve is closed; the equalization valve is open; and, the annular packer 121 and anchor 122 are unset. Perforations 99 through the casing 101 and into the formation adjacent nozzles 12 may be formed by sand jet perforating.

Following the perforating operation illustrated in FIG. 11A, the tool may be moved uphole sufficiently to align sleeve ports 65 with perforations 99. It will be appreciated that the required distance for this move is known from the dimensions of the tool—i.e., the distance between nozzles 12 and sleeve port 65 with mandrel 15 extended. After moving the tool the required distance to position sleeve ports 65 adjacent perforations 99 in formation 103, weight may be applied to the tubing string 25 to change the state of the tool to that shown in FIG. 9—i.e., the frac valve is open; the equalization valve is closed; and, the annular packer 121 and anchor 122 are set. Fracking fluids pumped down the tubing string impinge on wedge 70 and are forced to exit via windows 65. Downhole flow of fracking fluids is prevented by annular packer 121. The upward flow of fracking fluids may be prevented by applying fluid pressure in annulus 102 from the surface. Thus, the fracking fluids are forced into formation 103 via perforations 99.

Referring now to FIG. 1A, an embodiment of fracturing valve 10 (also herein referred to as a "frac valve") is shown. Frac valve 10 includes tubular mandrel 15, having a throughbore 20 extending therethrough. Tubular mandrel 15 may be joined at either end to lengths of tubing string 25. Throughbore 20 of tubular mandrel 15 may be fluidically continuous with tubing string 25 in which frac valve 10 may be connected. Tubing string 25 may be connected to a string of coiled tubing (not shown) extending to the surface of the wellbore. The coiled tubing has a bore for the passage of fluids, the bore being continuous with throughbore 20 of tubular mandrel 15.

Outer sleeve 30 may be radially disposed around the outer surface of frac valve 10. Generally, outer sleeve 30 may be of a diameter such that tubular mandrel 15 may be slidable axially relative to outer sleeve 30. The diameter of outer sleeve 30 may be chosen so that there is minimal clearance between outer sleeve 30 and tubular mandrel 15. For example, the clearance may be as small as 0.005 inches on each side of the tubular mandrel, for a total of 0.01-inch clearance between outer sleeve 30 and tubular mandrel 15. This small clearance helps to prevent excess fluid flow between outer sleeve 30 and tubular mandrel 15, and helps to prevent wear on the seals disposed between tubular mandrel 15 and outer sleeve 30.

The upper end 31 of outer sleeve 30 may be retained against tubular mandrel 15 by at least one upper seal which, in the embodiment shown, is O-ring 46. Seals other than an O-ring may be employed. O-ring 46 may be disposed within a groove encircling the outer circumference of outer sleeve 30. Wiper 48 is also present in the illustrated embodiment. One or more back-up rings 44 may also be present. In some embodiments, one or more seals may be present and/or a seal assembly may be present, the seal assembly comprising one or more wipers, one or more seals and one or more back-up rings. When present, wiper 48 engages tubular mandrel 15 so as to remove debris or sand from the tubular mandrel as it moves relative to outer sleeve 30. Because O-ring 46 is disposed in a groove on outer sleeve 30, it does not slide when tubular mandrel 15 slides, since the sleeve may be held stationary while tubular mandrel 15 slides axially relative to sleeve 30.

The lower end 32 of outer sleeve 30 may be retained against tubular mandrel 15 by a lower seal, which in the illustrated embodiment is a cup seal 47. Other seals may be employed. Cup seal 47 may be disposed within a seal housing 151 (as seen in FIG. 7A). In the illustrated embodiment, seal housing 151 (see FIG. 7A) acts at least in part as a connecting means to place (space) tubular mandrel 15 relative to equalization plug 35. In the illustrated embodiment, equalization plug 35, continuous with tubular mandrel 15, may be disposed with sealing ring 36. Also, seal housing 48 assists in holding cup seal 47 in place, and in holding alignment pin 13. Alignment pin 13 assists in controlling movement between outer sleeve 30 and tubular mandrel 15, helping to prevent rotational movement of outer sleeve 30 relative to tubular mandrel 15, and ensuring axial movement of tubular mandrel 15 relative to sleeve 30. Because cup seal 47 may be disposed within seal housing 48 surrounding tubular mandrel 15, movement of tubular mandrel 15 corresponds with sealing and unsealing of cup seal 47 against outer sleeve 30.

In the embodiment shown in the drawing figures, conventional seals, such as O-rings, are used. However, as would be recognized by a person skilled in the art, other types of seals may be used. By way of example, O-rings, cup seals, bonded seals, V-pak seals, T-seals, Sealco seals and back-up rings could be used.

Tubular mandrel 15 may be connected to other parts of the tubing string by a variety of means of connection. For example, the joining may be with pin connections that engage with threaded connections at each end of tubular mandrel 15. Similarly, outer sleeve 30 may also be connected to other parts of the tubing string by various means of connection. In the embodiment shown, outer sleeve 30 may be threadedly connected to an equalization housing. As explained below, the equalization housing may in turn be connected to a lower tubular or sub (e.g. lower mandrel) that may be held stationary against the wellbore (e.g., by means of a drag mechanism such as a mechanical collar locator, for example, while tubular mandrel 15 is moved up and down by pushing or pulling on the coiled tubing).

FIGS. 3 and 4 are perspective views of frac valve 10. Outer sleeve 30 includes sleeve port 65 extending through a sidewall of sleeve 30. Tubular mandrel 15 includes frac window 60 extending through tubular mandrel 15. As shown in FIG. 4, a sloped surface may be formed in the tubular mandrel starting at the lower end of window 60. The sloped surface will be referred to herein as wedge member 70.

As used herein, an "open" valve position means that fluid may travel from the tubing string to the formation through aligned window 60 and port 65. In this position, wedge 70 may be exposed to the exterior of the valve through window 60 (see FIG. 4). As used herein, a "closed" valve position means that substantially no fluid communication from the tubing string to the formation through frac window 60 is possible. In this position, wedge 70 is obscured by outer sleeve 30 (see FIG. 3), and seal 47 seals between the tubular 15 and sleeve 30, preventing fluid flow down the tubing string below seal 47.

When valve 10 is connected into a string, the valve may be placed in fluid communication with the bore of the tubing string 25 such that fluids passing through the string enter throughbore 20 and may flow as shown by arrows 21 in FIG. 1A and into the annulus about the tool when the valve is in the open position. When valve 10 is in a closed position, seal 47 prevents fluid from exiting via frac window 60.

It should also be understood that while fluid flow is discussed herein as being outwardly from the tubing string to the annulus, it may also be possible for fluid to flow inward, from the annulus to the tubing string, through frac window 60 and sleeve port 65, when window 60 and sleeve port 65 are aligned.

Actuation of frac valve 10 between the open and closed positions may be mediated by pushing down (also referred to herein as compressing or applying set down weight) or pulling up (also referred to herein as releasing set down weight on the tubing string) on the tubing string to which tubular mandrel 15 is attached. The open position of frac valve 10 is illustrated in FIG. 1A, while the closed position of frac valve 10 in illustrated in FIG. 2. More particularly, when tubular mandrel 15 is attached to coiled tubing, the tubing string may be compressed or pushed downward to slide tubular mandrel 15 relative to sleeve 30, resulting in wedge 70 being exposed through frac window 60 so that fluid flow out frac window 60 may be possible. In this position, the tubing string below the wedge may be sealed (e.g. by a slidable plug as one example which will be discussed below). Conversely, the tubing string may be pulled up, sliding tubular mandrel 15 upward relative to the sleeve 30, resulting in wedge 70 being obscured by sleeve 30, and seal 47 sealing between the tubular and the sleeve. No fluid may then flow from the tubing string out of window 60. As will be described in more detail below, in practice, sleeve 30 may be held stationary by virtue of its connection to a stationary portion of the tubing string, while tubular mandrel 15 may be moveable axially, upwards (when pulling up on coiled tubing) and downwards (when pushing down on coiled tubing) relative to sleeve 30.

When valve 10 is in the fully extended or tensile position (e.g. frac valve closed), the upper limit of travel of tubular mandrel 15 is limited when an external shoulder on mandrel 15 contacts an inner shoulder on sleeve 30. When valve 10 is in the compressed position (e.g. frac valve open), the lower limit of travel of tubular mandrel 15 occurs when equalization plug 35 is fully seated. Thus, in operation, sleeve 30 could be held stationary (for example, by virtue of its connection to a "stationary" or "locatable" tubular member below the sleeve in the tubing string. The stationary member may be held stationary by virtue of a drag mechanism capable of locating the tubular within the wellbore, while force is applied to tubular mandrel 15 by pushing on the tubing string, thereby moving tubular mandrel 15 down relative to sleeve 30 until tubular mandrel 15 hits a lower stop position. When it is desired to close valve 10, tubular mandrel 15 may be pulled upward relative to sleeve 30, until tubular mandrel 15 reaches an upper limit of travel. This up and down movement of the tubing string also controls the setting and unsetting of seal 47 against sleeve 30. As will be discussed below, in an illustrative embodiment, the up and down movement of the tubing string also actuates the closing and opening of a passageway in the tubing string below frac valve 10, and the setting and unsetting of a sealing assembly or packer element disposed on a lower mandrel.

As shown in FIG. 4, an alignment pin 13 travels along slot 115 in sleeve 30 in response to application or release of set down weight to the tubing string. While an alignment pin is shown in the embodiment, another suitable member (such as a lug) may be provided in either the tubular mandrel 15 or sleeve 30 for preventing rotation of sleeve 30 relative to tubular mandrel 15, ensuring that when set down weight is applied to or released from the tubing string, the movement of tubular mandrel 15 is axial. Alternative configurations and alignment means are possible. For example, a groove or other profile may be defined in the tubular mandrel, and a pin or other member capable of traveling within the profile may be defined in the sleeve for engaging the groove in the tubular.

As shown in FIGS. 4, 5, and 6, frac window 60 opens onto a sloped surface of tubular mandrel referred to herein as wedge 70 disposed within tubular mandrel 15 at the downhole end of frac window 60. Wedge 70 has a base 80 facing uphole and an apex 75. Efficient use and operation of valve 10 depends in part on the recognition that movement of proppant from the tubing string to the formation may be difficult due to the properties of the proppant. Selection of the shape, size and slope angle of wedge 70, and selection of the size and shape of window 60, assists in moving proppant-laden fluid from the coiled tubing string into the formation. Wedge 70 has a sloped surface, angled at an incline toward the downhole side of the valve 10. For example, the angle of wedge 70 from base 80 to apex 75 from the longitudinal axis of tubular mandrel 15 may be around 10-40 degrees from the horizontal axis of tubular mandrel 15. In the illustrated embodiment, the angle of wedge may be around 30 degrees. Wedge 70 may extend from about ¼ to ½ of the length of frac window 60. For example, in the illustrated embodiment, the distance between apex 75 and base 80 of wedge 70 is around 50 percent of the length of frac window 60. Further, the length of frac window 65 and the length of wedge 70 from apex 75 to base 80 may be fairly large in proportion to the valve stroke. In one example, the stroke length of the valve may be about 13 inches, frac window 60 may be about 11 inches in length, wedge 70 may be about 5.4 inches from base to apex, and the sloped surface of wedge 70 may be inclined at an angle of about 30 degrees. Therefore, frac window 60 may be almost the same length as the valve stroke.

The sloped surface of wedge 70 provides a large distribution surface for treatment fluid (e.g. proppant) pumped through the tubing string and impinging on the surface of wedge 70. Also, the shape of the wedge may assist in decreasing the velocity of fracturing fluid exiting the tubing string to the formation. Decreasing the velocity may prolong the life of the valve and tool in which the valve may be deployed. When valve 10 is used in a tool having a perforation plug, the fracturing rate may be decreased so as to be similar to the perforation rate. For example, Applicant has employed fracturing rates of 0.8 $m^3$/minute and perforation rates of 0.6 $m^3$/minute. However, the fracturing and perforation rates need not be the same—a valve according to the invention enables an operator to change fracturing rates as needed. The rates needed are dependent on the formation, and a valve according to the invention enables an operator to rapidly adjust the rate of fracturing according to the formation. When using higher velocities for fracturing, proppant may be less likely to settle out and remain in the coiled tubing.

As a person skilled in the art would appreciate, the present frac valve may actuate many functions by creating a pressure differential within the tool. For example, the valve may be used for tool setting, to allow for jetting (for example, in well cleaning functions) and to actuate parts of downhole tools. For example, when the valve is incorporated into a downhole tool having a perforation plug, the valve may be used to facilitate perforating and fracturing operations. Typically, a high pressure differential is required for fracturing through nozzles, for example. The present valve allows a lower pressure differential to be used for fracturing. The lower pressure differential assists in maintaining seal integrity and in maintaining the integrity of the tool itself. The high velocity of the proppant particles encountered in fracturing treatment may erode the steel of the tool. Accordingly, it may be desirable to use lower pressure during fracturing operations. The valve may be useful in reducing costs and time associated with fracturing, and may be used in many types of completion systems, including: open hole, deviated cased hole, multi-zone, multiple fractures in a cased vertical or horizontal wellbore and in wellbores having a horizontal slotted liner.

An illustrative embodiment of a tool containing valve 10 is shown in FIG. 7A. Tubular mandrel 15 may be connected at its lower end to equalization plug 35. At its upper end, tubular mandrel 15 may be connected to a perforation device 49, which may be a jet perforation device with nozzles 12. Perforation device 49 may be continuous with tubing string 25, which may be connected to a string of coiled tubing (not shown) extending to the surface of the wellbore. Using this tool, perforation may be carried out when valve 10 is in the closed position since there is no fluid delivery out of frac window 65 in this position. Once perforation is complete, valve 10 may be opened by pushing down on the tubing string, causing the sealing of the tubing string by equalization plug 35 and causing wedge 70 to be exposed in fracturing window 65. Fracturing treatment may be delivered down the tubing string, out of window 65 and port 60 (see FIG. 1A) into the formation. Thus, perforation and fracturing may be accomplished with the same tool by circulating appropriate treatment fluids down the coiled tubing string, without the need to reverse circulate any balls, without the need to trip uphole, and without the need to utilize the large amounts of fluids generally required when treatment fluids are pumped down the annulus. When using a valve according to the invention, no fracturing sleeves are required.

When it is stated that no reverse circulation is needed, it will be appreciated that any tool in which the valve may be deployed may have one or more ports for fluid communication between the tubing string and the annulus. Fluid may be circulated from the annulus to the tubing string through these ports to help with debris relief.

The downhole or lower end of wedge 70 extends into equalization plug 35. Plug 35 may be slidably disposed within an equalization housing 91. Equalization plug 35 is sized and shaped to sealingly engage a portion of the tubing string below frac valve 10. This lower portion will be referred to as equalization housing 91. In the illustrated embodiment, plug 35 and wedge 70 are made as different parts, but it will be appreciated that they may be made as one part, provided that wedge and plug are coupled to each other so as to be able to slide together. As tubular mandrel 15 may be continuous with the tubing string, plug 35 may be similarly actuable by application and release of weight applied to the tubing string. In an open position shown in FIG. 2, plug 35 is not sealed within lower mandrel 91' (and therefore, fluid may pass down the tubing string through lower mandrel 91'). In a closed position shown in FIG. 1A, plug 35 may be sealingly engaged in lower mandrel 91' (and therefore, fluid may be prevented from traveling down the tubing string through lower mandrel 91').

When the tubing string is compressed, plug 35 slides within housing 30 and becomes engaged within lower mandrel 91'. In this position, fluid flow down the tubing string is prevented. Plug 35 includes sealing surfaces 92. Sealing surfaces 92 (e.g., bonded seals) are capable of sealingly engaging cap 95 within sealing ring 36. When upward force is applied to the tubing string, plug 35 may be released from sealing engagement within sealing ring 36. Fluid may flow down the tubing string to lower mandrel 91'. Both the opening and closing of frac valve 10 and the sliding of plug 35 are actuated by weight applied through coiled tubing. When the frac valve is open (tubing string is compressed or pushed), plug 35 may be engaged within lower mandrel 91'. When frac valve 10 is closed (tubing string is extended or in tensile mode), plug 35 is not engaged within lower mandrel 91'.

Other arrangements of the plug 35 to block fluid delivery are possible. For example, the plug may directly engage a tubular member (without a cap being present), or the sealing ring 36 may be part of the same tubular as lower mandrel 91' (e.g., the parts need not be manufactured as separate parts provided plug 35 may slide within it).

There may be multiple circulation ports 45 extending through the lower portion of sleeve 30. Fluid may be circulated from the annulus into ports 45 to assist in debris removal and in equalization. Removing debris by reverse circulation may be useful. Because the coiled tubing has a flow bore of smaller cross sectional area than the annulus cross section, the flow rates required to keep the debris in suspension may be reduced. Lower flow rates are desirable to prevent erosion within the coiled tubing.

Further illustrative examples of downhole tools are provided in FIGS. 8 and 9. Tool 200 includes valve 10, perforation device 49 and equalization plug 35 and lower mandrel 91'. Sealing element 121 and anchor 122 are disposed below plug 35 and surround lower mandrel 91'. A J-slot 123 may be grooved into lower mandrel 91'. Sealing element and anchor 122 are actuated by movement of a pin along the J-slot 123. Equalization plug 35 may be proximate multiple ports 45 adapted to permit fluid communication between the tubing string and the annulus surrounding the tool. A mechanical collar locator 94 may be disposed around bottom sub 93. It will be appreciated that lower mandrel 91 may be slidable with respect to bottom sub 93. There may be ports 130 within bottom sub 93 in the region of mechanical collar locator 94 for fluid communication between the tubing string and the annulus and to assist in debris relief. A bullnose centralizer 135 may be present at the bottom of the tool.

It is noted that the sealing assembly and J-slot shown in tool 200 are similar to those described in Canadian Patent No. 2,693,676, which is also assigned to the assignee of the present applicant and is incorporated herein by reference in its entirety. In particular, it is contemplated that the tool in which valve 10 may be installed may have debris relief features. For example, tool 200 may have fluid passageways (ports, apertures or the like) to allow for fluid passage between the tubing string and annulus associated with one or more of the J-slot, the mechanical collar locator, the equalization plug, etc. These debris-relief features are described in Canadian Patent No. 2,693,676. The presence of debris-relief features assists in using the tool in the debris-laden environments typically encountered when operations such as perforation and fracturing are performed.

It will be recognized that the tool shown in FIGS. 7A, 8 and 9 is merely an illustrative example and that valve 10 may be incorporated into a multitude of possible tools.

Operation

Fracturing involves the high-pressure injection of a proppant-containing fluid down a wellbore annulus and into the formation through openings in the casing into the fractures formed in the formation during the perforation process. The fracturing pressure may be very high and may be generated at the surface. As noted above, it may be desirable to reduce the fracturing pressure and velocity of the fracturing fluid pumped down coiled tubing. Also, it may also be desirable to change from a perforating operation to a fracturing operation on the fly. Finally, it may be desirable to have flexibility in the pressure used for fracturing and perforating. For example, in some cases, it may be desirable to use the same pressure for each operation, whereas in other cases, it may be desirable to use a different pressure for fracturing than that for perforating. The present frac valve may be useful in the process of running a tubing string a long distance into the wellbore, then fracturing by pumping fluid(s) down the tubing. Downhole proppant concentration may be changed readily by increasing or decreasing the flow rate down the tubing string.

Figure 11B:
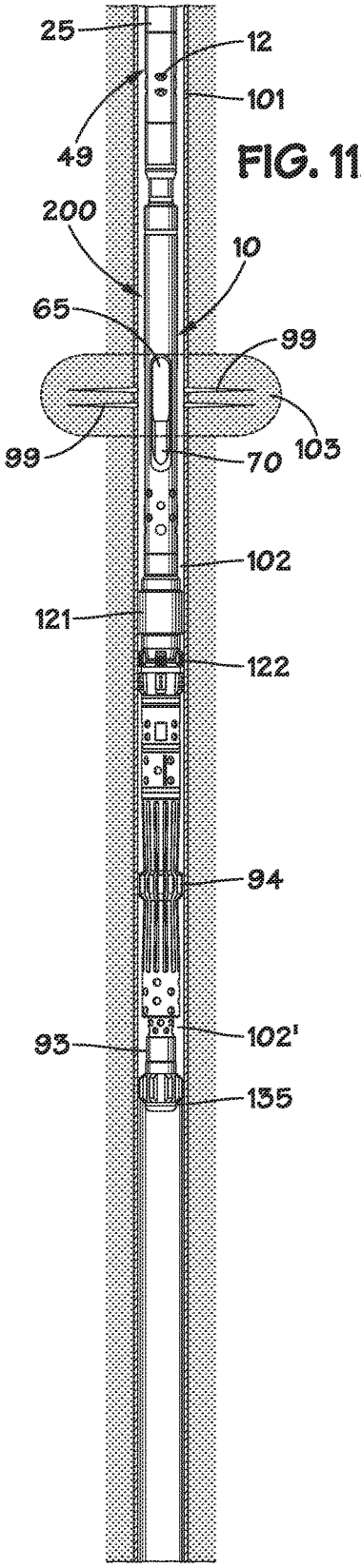
FIG. 11B is a side view, partially in cross section, of the downhole tool illustrated in FIG. 11A positioned for a fracturing operation within a cased wellbore. The fracturing valve is shown in the open position; the equalization valve is shown in the closed position; and, the bridge plug is set.

FIGS. 11A and 11B are schematic representations showing the typical operation of a tool equipped with fracturing valve 10. Once the well is ready to be completed, tool 200 containing fracturing valve 10 may be run downhole on a tubing string. During run-in, frac valve 10 is in the open position. Annulus 102 may be formed between casing 101 and the tubing string containing tool 200. Once the desired position for perforation is identified, tool 200 may be run past that position, and then, the operator may start pulling up on the tubing string, and tool 200 may be pulled upwards towards the surface of the wellbore. Mechanical collar locator 94 may be profiled to engage casing 101. While tool 200 is being pulled upwards, frac valve 10 may be moved from the open to closed position. In this closed valve position, perforating fluid may be pumped down the tubing string to exit the perforation nozzles 12 on perforation device 49. Perforation may be carried out for around 5-10 minutes, for example. This creates perforations 99. Because the tubing string is in the tensile or extended position during perforation, plug 35 is not seated within equalization housing 91. Also, sealing element 121 and anchor 122 are not engaged against casing 101.

Once perforation is complete, fluid may be pumped down the coiled tubing and/or annulus to clean tool 200 of perforation fluid. As shown in FIG. 11B, tool 200 may be moved so that fracturing window 65 approximately aligns with the position of newly formed perforations 99. The tubing string may be then compressed or pushed down. This causes sealing assembly 121 to be activated, causing anchor 122 and sealing element 121 to seal off the wellbore between the tool 200 and casing 101. As the tubing string is compressed, tubular mandrel 15 moves downward, exposing wedge 70 to the annulus. The fracturing process may be initiated when fracturing fluids are pumped down the tubing string, impinging on wedge 70. The fracturing fluid may contain proppant (e.g. a sand slurry). The proppant may be ejected from the tubing string into the formation through frac window 65, as represented by 103. The proppant may fill the fractures and keep them open after the fracturing stops. Valve 10 may be kept open as long as may be necessary for satisfactory fracturing to occur. After fracturing operations are performed, various post-fracturing activities may be conducted. Once fracturing treatment ends, a displacement fluid may be used to push the proppant down the coiled tubing to the formation.

Prior to pumping fracturing treatment, a pad fluid may be pumped down the annulus and/or coiled tubing. A pad fluid is the fluid that may be pumped before the proppant is pumped into the formation. It ensures that there is enough fracture width before the proppant reaches the formation. In some cases, the pad fluid may be optional. When a pad is used, a pad displacement may also be used prior to fracturing treatment.

Treatment normally occurs at the bottom of the wellbore first and each successive interval of the formation may then be treated, working upwards in the wellbore toward the surface once the first interval is treated. Tool 200 may then be moved to the next region or interval of the formation to be perforated. To accomplish this, an upward pull on the coiled tubing causes sealing element 121 to unset, plug 35 to move to an unseated position within housing 30, and frac valve 10 to close. Tool 200 may then be moved to the next zone to be perforated. In multi-zone wells, this fracturing process may be repeated for each zone of the well. Thus, tool 200 may be moved to successive zones to be treated, and the process repeated.

Figure 12A:
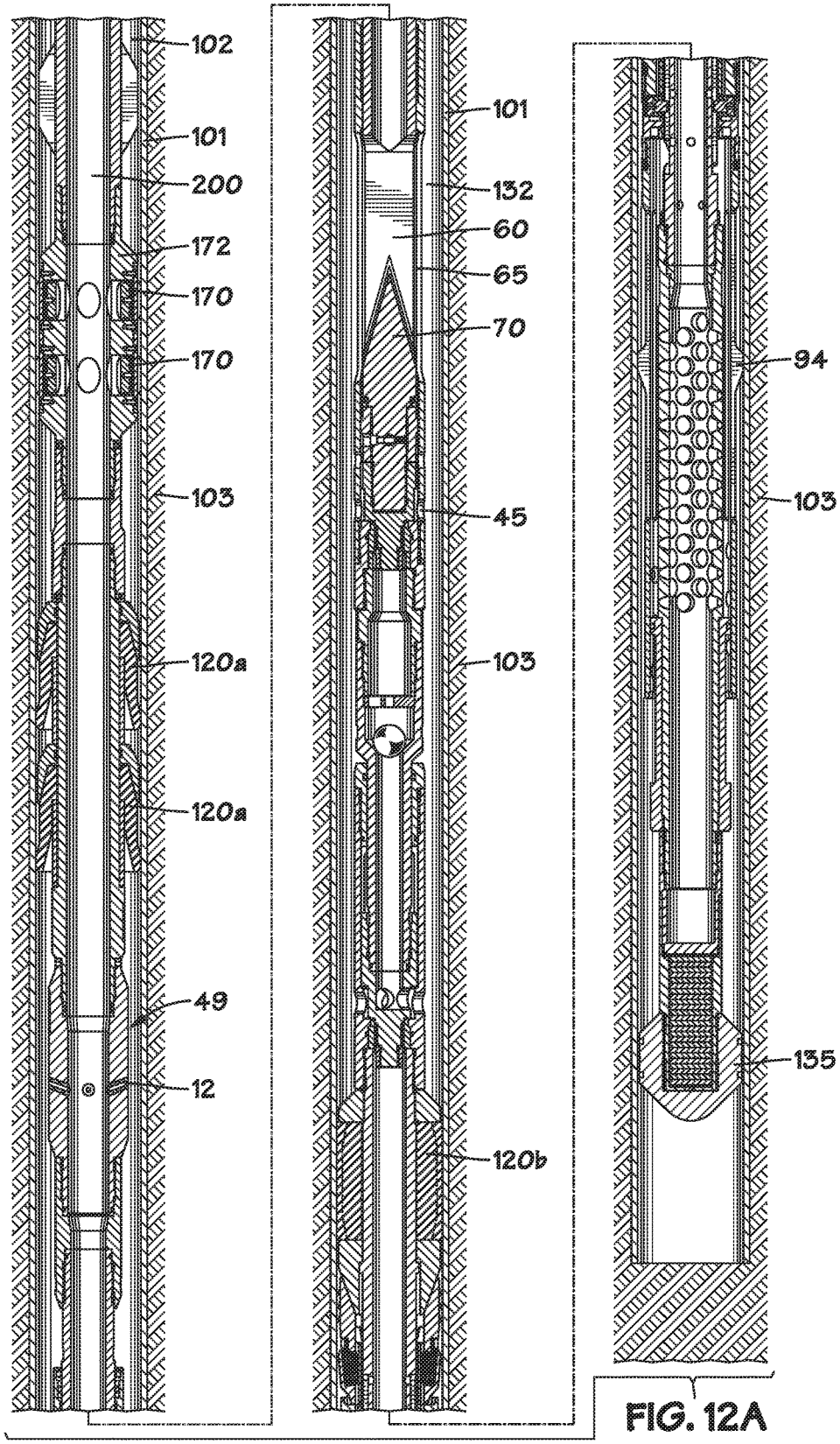
FIG. 12A is side view of one embodiment of the tool string and fracturing valve for use in pin point treatments, showing the hydraulic hold down buttons engaged.
Figure 12B:
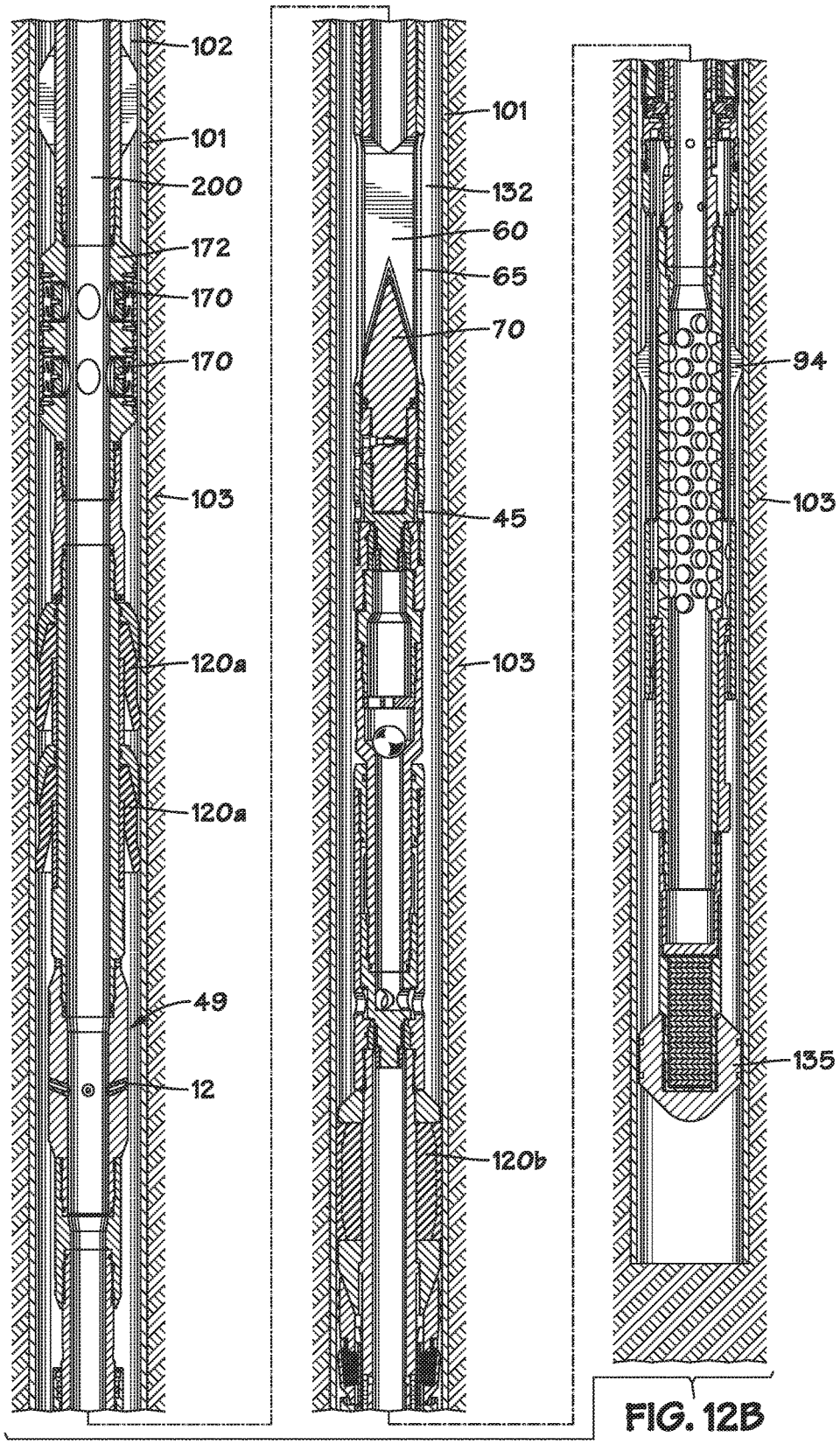
FIG. 12B is side view of one embodiment of the tool string and fracturing valve for use in pin point treatments, showing the hydraulic hold down buttons dis-engaged.

In another embodiment of a tool string for use with the valve 10 of the present invention, in addition to the lower sealing 121 and anchor mechanism 122 of FIGS. 11A and 11B, below the valve 10 and perforating device 49, an upper sealing mechanism above the perforating device 49 is added to allow perforations and treatments to be isolated from perforations above and below. FIGS. 12A and 12B show the tool string of another embodiment used for pinpoint treatments. The figures are laid out so the portion of the tool that is furthest uphole is in the top left, and the lowest most portion of the tool string is in the bottom right. So the section on the left stacks on top of the middle section and those two stack on top of the right section to show the full tool string. As shown in FIG. 12A, a lower sealing element 120B, which in a preferred embodiment would be sealing element 121 and anchor element 122, and an upper sealing element 120A is shown. In a preferred embodiment, the upper sealing element 120A is a cup sealing element. This creates a treatment zone 132 between the sealing elements.

Once the tubing conveyance string has been set down so as to put weight down on the valve 10 to cause it to open, the treatment of the select zone in the treatment zone can begin. As pressure is increased in the treatment zone, the upper sealing elements will be energized to seal against the casing string or wellbore. In this embodiment, there will be upward pressure on the upward sealing element 120A that will tend to push the upper section of the tool and the tubing conveyance string up hole. If the upper tool were allowed to move up, it would close the valve 10, disrupting the treatment. As such, in a preferred embodiment, the present invention uses a hydraulic hold down 172 above the upper sealing element 120A. The hydraulic hold down 172, has hydraulic hold down buttons 170 that as the pressure reaches a certain point inside the hydraulic hold down 172, the hydraulic hold down buttons are forced out against the casing and bite into the tubular enough to prevent any upward movement while the pressure exists in the hydraulic hold down and conveyance tubing string, i.e., during the treatment. In FIG. 12A the hydraulic hold down buttons 170 are shown engaged, pressed into the casing 101 and holding down the tubing string and tool. Once the pressure is relieved or lowered, the hydraulic hold down buttons are released and can be disengaged from the casing to allow for ease of movement. In FIG. 12B the hydraulic hold down buttons 170 are shown as released or disengaged, such that the tool string can move up or down without being impeded by the hydraulic hold down 172. All other numbering in FIGS. 12A and 12B are consistent with the numbering in the other figures In an additional embodiment, the tool string can be provided with a ball seat mechanism at the top of the tool where it connects with the tubing conveyance string, such that dropping of a ball to seal in the ball seat mechanism and then pressuring up can cause the tubing conveyance string to be disconnected from the tool string.

The present frac valve avoids the need for ball-seat valves to divert fluid flow. In downhole tools having ball-seat valves, once perforation has occurred, it may be necessary to pump fluid down the annulus, and through the frac ports to the tubing string in order to reverse circulate the ball up the coiled tubing to the surface. In long wells, this pumping of the ball up to the surface may take 10-15 minutes, adding cost and time to the frac operation. Using a frac valve according to the invention, once perforation is complete, a small amount of cleaning fluid may be pumped down the coiled tubing to initiate breakdown of the formation. Thereafter, proppant may be pumped down the coiled tubing. As there is no ball-seat valve employed, there may be no need for reverse circulation. This results in additional cost and fluid savings (in addition to the fluid savings resulting from the difference in volume of the coiled tubing versus the annulus).

Although particular embodiments of the present invention have been shown and described, they are not intended to limit what this patent covers. One skilled in the art will understand that various changes and modifications may be made without departing from the scope of the present invention as literally and equivalently covered by the following claims.

What is claimed is:

1. A wellbore treatment assembly comprising:

a fracturing valve for a downhole tool, the fracturing valve comprising, a tubular having a through bore, and a window formed through the tubular, an outer sleeve disposed around the tubular, the outer sleeve having a port formed in a sidewall of the outer sleeve, the fracturing valve being arranged such that the tubular and the outer sleeve are axially moveable relative to one another from a first position in which the window and the port are aligned such that fluid in the through bore above the port can exit the fracturing valve through the aligned window and port and a second position in which fluid in the through bore above the port cannot exit the fracturing valve and the fracturing valve being further arranged such that movement from the first position to the second position can be made by applying a mechanical force to the tubular sufficient to move the tubular relative to the outer sleeve;

a tubing string that can be manipulated from a surface, into which the fracturing valve is connected such that the through bore of the tubular is fluidically continuous with a flow path of the tubing string;

a lower seal element below the fracturing valve configured to seal an annulus between the downhole tool and a casing lining the wellbore;

an upper seal element above the fracturing valve configured to seal the annulus between the downhole tool and the casing;

an equalization plug disposed on the tubing string below the window of the tubular, the equalization plug being actuable between an open position in which fluid flow to the tubing string below the fracturing valve is enabled to a closed position in which fluid flow to the tubing string below the fracturing valve is prevented, wherein the actuation of the equalization plug from the open position to the closed position can be effectuated by applying a mechanical force to the equalization plug and actuation of the equalization plug from the open position to the closed position effectuates movement of the fracturing valve from the second position to the first position.

2. The assembly of claim 1, wherein the mechanical force is effectuated by manipulation of the tubing string.

3. The assembly of claim 2, wherein pushing down on the tubing string actuates the fracturing valve from the first position to the second position.

4. The assembly of claim 2, wherein the equalization plug comprises a stem sealingly engageable with the tubing string below the fracturing valve when set down weight is applied to the tubing string.

5. The assembly of claim 1, further comprising:

a wedge continuous with the tubular, the wedge being exposed through the window when the fracturing valve is in the first position and wherein the wedge is coupled to the equalization plug such that the equalization plug and the wedge move together in response to mechanical force.

6. The assembly of claim 1 wherein the lower seal element is an annular packer.

7. The assembly of claim 6 further comprising:

a J-slot actuator for the annular packer.

8. The assembly of claim 1 wherein the upper seal element comprises a cup seal.

9. The assembly of claim 1, wherein a lower end of the window of the fracturing valve opens to a wedge continuous with the tubular, the wedge being exposed through the window when the fracturing valve is in the first position.

10. The assembly of claim 1, further comprising: an upper valve seal in the fracturing valve positioned between the outer sleeve and the tubular; and a lower valve seal in the fracturing valve positioned at a lower end of the outer sleeve to seal between the outer sleeve and the tubular.

11. The assembly of claim 10, wherein the lower valve seal slides axially with the tubular of the fracturing valve so that in the second position the lower valve seal is sealing between the outer sleeve of the fracturing valve and the tubular thereby preventing fluid flow to the tubing string below the lower valve seal.

12. The assembly of claim 9, wherein the wedge has a surface that slopes radially outward toward a lower end of the tubular at an angle of between about 10 degrees to about 40 degrees from a longitudinal axis of the tubular.

13. The assembly of claim 1, further comprising:

an alignment mechanism in the fracturing valve comprising a groove formed in the outer sleeve and a pin disposed on the tubular.

14. The assembly of claim 1, further comprising:

at least one circulation port in the outer sleeve and below the window of the fracturing valve sized and configured for circulating debris from the annulus to the tubing string.

15. The assembly of claim 1, further comprising:

a hydraulic hold down configured to resist axial movement of the tubular and the outer sleeve relative to one another when fluid pressure sufficient for hydraulic fracturing is applied to the through bore of the tubular.

16. A downhole tool comprising:

a jet perforation device disposed on a tubing string;

a fracturing valve on the tubing string below the jet perforation device, the fracturing valve comprising a tubular having a through bore, the tubular being adapted to be connected in the tubing string, the tubular having window formed through the tubular, an outer sleeve disposed around the tubular, the outer sleeve having a port formed in a sidewall of the outer sleeve, the fracturing valve being arranged such that the tubular and the outer sleeve are axially moveable relative to one another from a first position in which the window and the port are aligned such that fluid can exit the fracturing valve through the aligned window and port and a second position in which fluid cannot exit the fracturing valve and the fracturing valve being further arranged such that movement from the first position to the second position can be effectuated by applying a mechanical force to the tubular, wherein fluid pumped down the tubing string when the fracturing valve is in the second position is forced to exit the downhole tool via the jet perforation device;

a lower seal element below the fracturing valve configured to seal an annulus between the downhole tool and a casing lining the wellbore; and an upper seal element above the fracturing valve configured to seal the annulus between the downhole tool and the casing.

17. The tool of claim 16, wherein the tubular further comprises:

a wedge formed on the tubular, downhole of the window, the wedge configured for diverting fracturing treatment fluid pumped through the tubing string to the exterior of the downhole tool when the fracturing valve is in an open position.

18. The tool of claim 17, wherein the wedge is exposed to an exterior of the downhole tool when the fracturing valve is in the first position.

19. The tool of claim 16, further comprising:

a lower valve seal disposed between the tubular and the outer sleeve to prevent fluid flow out of the downhole tool through the port when the fracture valve is in a closed position.

20. The tool of claim 16, further comprising:

an equalization plug adapted to be disposed on the tubing string below the fracturing valve, the equalization plug being actuable from an open position in which fluid flow below the equalization plug is permitted to a closed position in which fluid flow below the equalization plug is prevented, the actuation between the open and closed positions being effectuated by applying a mechanical force to the equalization plug.

21. The tool of claim 17, further comprising:

an equalization plug adjoined to the wedge, the equalization plug slidable between an open position and a closed position by applying a mechanical force to the tubular.

22. The tool of claim 16, wherein the upper seal element above the fracturing valve comprises one or more cup seals.

23. The tool of claim 16, further comprising:

a mandrel on the tubing string below the fracturing valve, the outer sleeve connected to the mandrel in such a way that the mandrel is held stationary while the tubular moves relative to the outer sleeve by pushing or pulling on the tubing string.

24. The tool of claim 16 further comprising:

a hydraulic hold down configured to resist axial movement of the tubular and the outer sleeve relative to one another when fluid pressure sufficient for hydraulic fracturing is applied to the through bore of the tubular.

25. A method of fracturing a cased wellbore, the method comprising:

running a tool on a tubing string into the cased wellbore to a required depth, the tool including a fracturing valve, the fracturing valve being actuable from a first position in which fluid can exit the fracturing valve to an annulus formed between the tubing string and a casing in which the tool is deployed, to a second position in which fluid cannot exit the fracturing valve to the annulus;

perforating the casing while the fracturing valve is in the second position;

setting an annular packer below the fracturing valve;

sealing the annulus above the fracturing valve;

pulling up on the tubing string to actuate the fracturing valve to the first position; and circulating a treatment fluid down the tubing string through a passageway leading from the tubing string through the fracturing valve, and into a formation through perforations created by the perforating of the casing while the fracturing valve is in the second position, wherein the step of circulating the treatment fluid includes impinging the treatment fluid on a wedge disposed in the tubular.

26. The method of claim 25, wherein pushing down on the tubing string seals a fluid passage to the tubing string below the fracturing valve.

27. The method of claim 25, wherein the step of setting the annular packer below the fracturing valve is performed by pushing down on the tubing string prior to the step of circulating the treatment fluid.

28. The method of claim 25 further comprising:

actuating a hydraulic hold down configured to prevent actuation of the fracturing valve when fluid pressure sufficient for hydraulic fracturing is applied down the tubing string.

29. A method of perforating and fracturing a formation intersected by a wellbore, the method including the steps of:

(a) deploying a tool on a tubing string into the wellbore, the tool having a perforation device and having the capability of carrying out fracturing following perforation by pushing down on the tubing string to open a fluid passageway in the tool continuous with the tubing string and with an exterior of the tool when the tubing string is pushed down, such that fracturing fluid can exit the tubing string through the fluid passageway to the formation;

(b) perforating an interval of the formation;

(c) pushing down on the tubing string;

(d) sealing the wellbore above and below the fluid passageway in the tool;

(e) pumping a fracturing treatment fluid through the tubing string into the perforations created by the perforation device without removing the tool from the formation between perforation and fracturing, further comprising pumping the fracturing treatment fluid down the tubing string and through a fracturing window on the tool below the perforation device, the fracturing window being exposable to the formation when the tubing string is pushed down.

30. The method of claim 29, further comprising:

setting a hydraulic hold down when pumping the fracturing treatment fluid through the tubing string.

31. The method of claim 29, further comprising:

repeating steps (b), (c), (d), and (e) for at least one additional interval of the formation.

* * * * *